United States Patent [19]

Cooper et al.

[11] Patent Number: 4,716,096

[45] Date of Patent: Dec. 29, 1987

[54] METHOD AND APPARATUS FOR PRODUCING CHARACTERS ON A GRIT-ERODIBLE BODY

[75] Inventors: Larry L. Cooper, Bowling Green; Philip G. Saunders, Maumee, both of Ohio

[73] Assignee: Container Graphics Corporation, Maumee, Ohio

[21] Appl. No.: 549,078

[22] Filed: Nov. 7, 1983

Related U.S. Application Data

[63] Continuation-in-part of Ser. No. 458,839, Jan. 18, 1983.

[51] Int. Cl.[4] ..... G03C 5/00

[52] U.S. Cl. ..... 430/323; 430/325; 430/327; 430/329; 51/262 R; 51/311; 51/312

[58] Field of Search ..... 430/323, 5, 396, 327, 430/329, 325; 51/310, 311, 312, 262 R

[56] References Cited

U.S. PATENT DOCUMENTS

| | | | |
|---|---|---|---|
| 1,954,672 | 4/1934 | Kavanaugh | 51/310 |
| 2,292,996 | 8/1942 | Helgeson | 51/311 |
| 3,579,926 | 5/1971 | Gaspari | 51/262 |
| 3,808,751 | 5/1974 | Usui | 51/312 |

FOREIGN PATENT DOCUMENTS

| | | | |
|---|---|---|---|
| 53-099258 | 8/1978 | Japan | 51/312 |

*Primary Examiner*—John E. Kittle
*Assistant Examiner*—José G. Dees
*Attorney, Agent, or Firm*—Allen D. Gutchess, Jr.

[57] ABSTRACT

A method and apparatus for producing characters on a surface of a grit-erodible body are provided. A negative of the characters is first produced, usually photographically. Ultraviolet light is then directed through the negative onto a blasting mask blank comprising a backing sheet and a uniform layer of polymerizable material thereon. Light struck portions of the layer harden and the rest is washed away to produce the characters, and specifically a font of type. Selected characters are then positioned backward on a transfer sheet and transported to the surface of the body of grit-erodible material to which they are adhered, with the transfer sheet then peeled away. Blasting grit is then directed toward the surface to erode the grit-erodible material around the characters to a desired depth.

13 Claims, 8 Drawing Figures

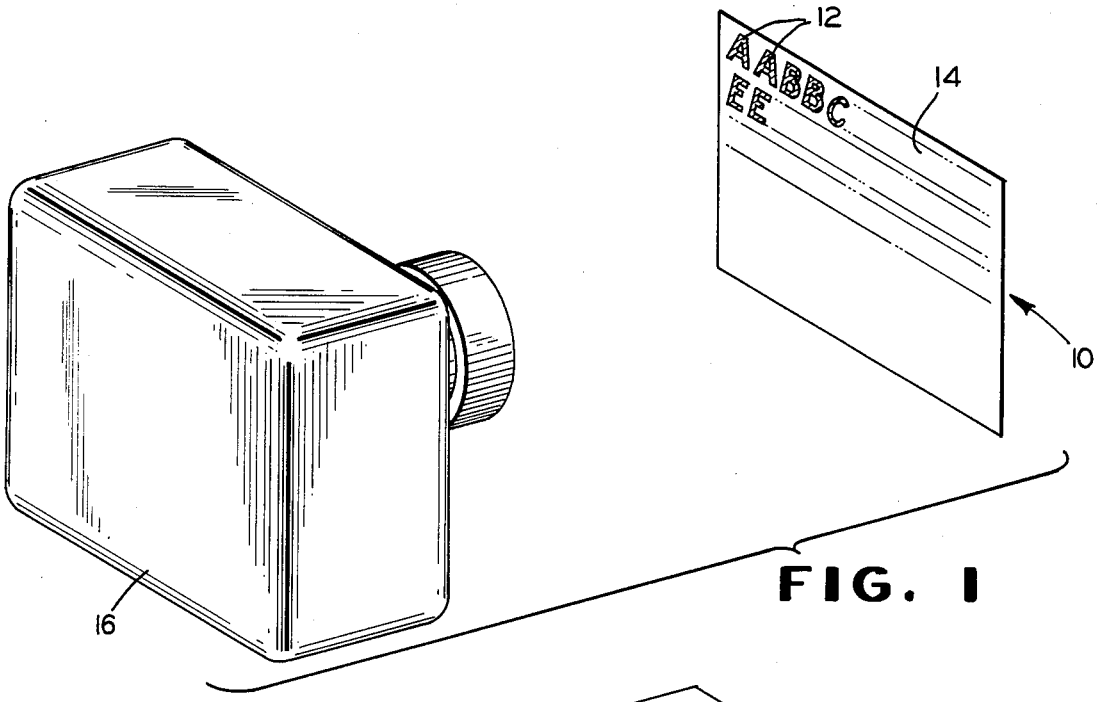
FIG. 1
FIG. 2
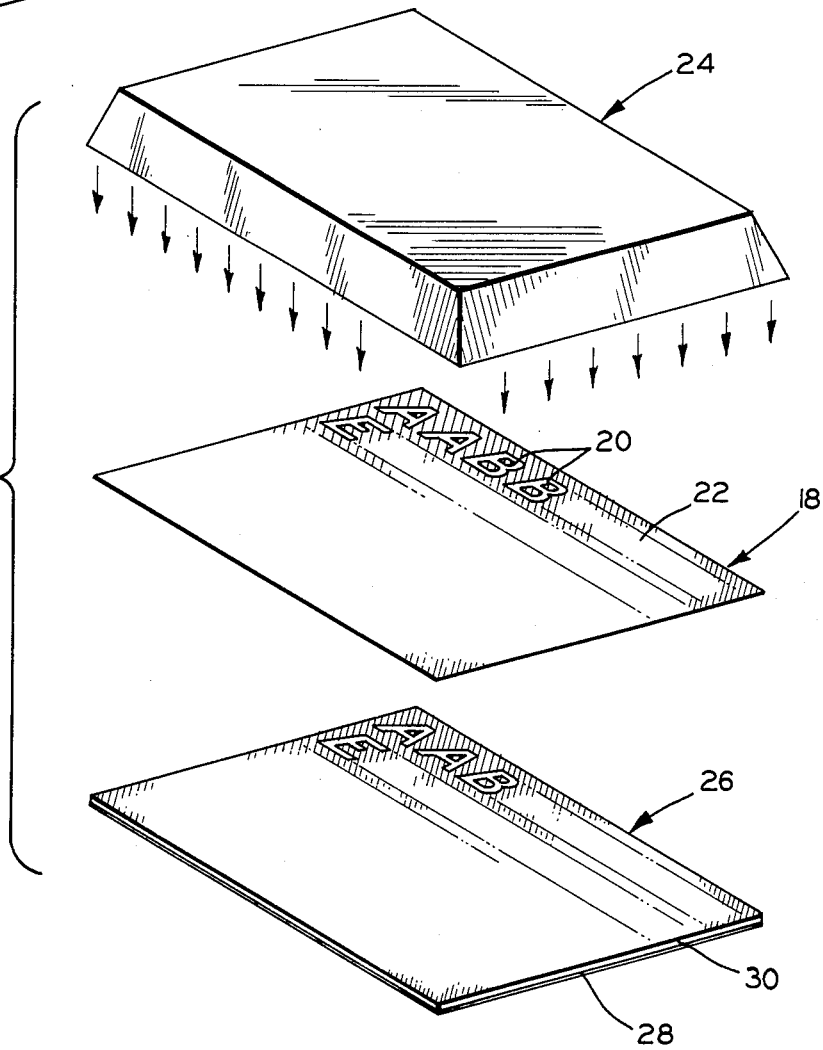

METHOD AND APPARATUS FOR PRODUCING CHARACTERS ON A GRIT-ERODIBLE BODY

This application is a continuation-in-part of our copending U.S. application Ser. No. 458,839, filed Jan. 18, 1983.

This invention relates to a method and apparatus for producing characters on a body of grit-erodible material.

In producing the characters on the body, a negative of the characters is first produced, usually photographically. For example, the negative can be produced with a camera photographing a sheet with the characters printed thereon. A blasting mask blank is also provided, this including a backing sheet on which is a uniform layer of photosensitive or polymerizable material thereon. The negative is placed in closely adjacent relationship with the blasting mask blank and light triggering waves, usually ultraviolet light waves, are directed through the negative onto the blasting mask blank. Those portions of the layer struck by the waves are hardened or polymerized and the rest of the layer remains soft or liquid and is removed, as by being washed away. This material is completely removed to leave the bare backing sheet therebelow with sharp lines defining the three-dimensional characters of the hardened material on the backing sheet. The backing sheet preferably has a smooth, glossy surface with the characters of hardened material adhered thereto but capable of being peeled away and placed back in position once again.

The characters can be removed from the backing sheet and placed on the surface of a body of grit-erodible material which is to be blasted. Blasting grit can then be directed toward the surface to erode the material around the characters to the desired depth. The characters can then be removed from the surface and placed back on the backing sheet for subsequent reuse.

Rather than placing the characters directly on the body of grit-erodible material, they are preferably first reversed and placed on a transfer sheet in proper spaced relationship with a guide sheet below the transfer sheet. The characters can then be subsequently transferred in proper spaced relationship from the transfer sheet to the grit-erodible body. For this purpose, the transfer sheet is of light-transmitting plastic material and preferably has one relatively glossy surface to which the characters will be removably adhered. It also preferably has mutually-perpendicular grid lines thereon to aid in aligning and spacing the characters. The guide sheet has two-dimensional characters printed thereon in proper spaced relationship, which characters are of the same size and shape as those on the backing sheet, but in reverse.

The transfer sheet is positioned on the guide sheet preferably with a horizontal grid line aligned with the bottom of a row of letters on the guide sheet. The selected three-dimensional characters are then peeled off the backing sheet and adhered to the smooth surface of the transfer sheet in reverse order, in superimposed relationship with the appropriate printed characters on the guide sheet. After the first character is positioned on the transfer sheet, the transfer sheet is then moved to place the first character over a printed character on the guide sheet which is adjacent to the next character on the guide sheet which corresponds to the next character to be positioned on the transfer sheet from the backing sheet. The next character is then removed from the backing sheet, is reversed, and placed on the transfer sheet in superimposed relationship over the next character on the guide sheet.

When the desired words have been formed by the three-dimensional characters in their proper spaced relationship on the transfer sheet, it is then moved to the grit-erodible body. Adhesive is first applied to the surface of the body to be eroded or to the characters. The transfer sheet is then turned upside down with the characters thereon properly positioned on the grit-erodible surface on which a line can first be drawn for alignment purposes, if desired. The three-dimensional characters are adhered to the surface of the body and the transfer sheet is then peeled away. Blasting grit is then directed toward the surface to erode the body around the characters to the desired depth. The characters can then be removed from the surface and placed back on the backing sheet for subsequent reuse. The characters are not only resistant to the grit but are extremely flexible and have a high degree of memory to return to their original shape, if deformed.

The font of characters enables signs of almost any desired message to be produced economically and quickly. It is not necessary to produce a special mask for each message and the reusable characters make the process most economical.

It is, therefore, a principal object of the invention to provide a method and apparatus for producing characters on a surface of a grit-erodible body having the objects and advantages discussed above.

Many other objects and advantages of the invention will be apparent from the following detailed description of preferred embodiments thereof, reference being made to the accompanying drawings, in which:

FIG. 1 is a schematic view in perspective of a font of type printed on a sheet and being photographed by a camera;

FIG. 2 is an enlarged, schematic view in perspective of a negative, a blasting mask blank, and a source of triggering energy waves for producing an image on the blank corresponding to the image on the negative;

Figure 3:
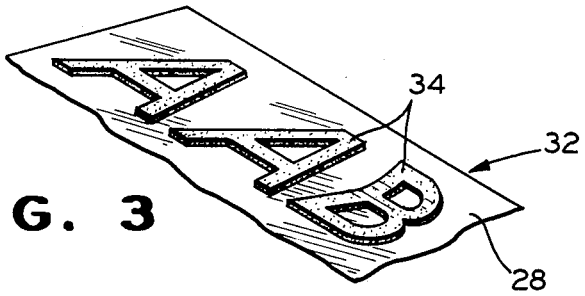
FIG. 3 is a fragmentary view in perspective of a font of type resulting from the processed grit-blasting mask blank and comprising a thin backing sheet and a multiplicity of characters adhered thereto.

Referring to FIG. 1, a font of type indicated at 10 has a multiplicity of characters 12 printed on a sheet 14. The characters 12 can include letters and numerals along with punctuation marks, if desired, all of one style, as is known in the art. The characters are positioned in lines in an orderly, spaced fashion. A suitable camera 16 is utilized to photograph the font to produce a wave-control sheet or negative 18 (FIG. 2). The negative 18 has light or clear areas 20 thereon corresponding to the characters 12 with a dark or opaque background 22. The negative 18 can also be produced by other techniques, such as by drawing the appropriate shapes on a light-transmitting sheet or by using a silk screen process, by way of example.

A source 24 of triggering energy waves, such as an ultraviolet light, is then positioned on one side of the negative 22 and a blasting mask blank 26 is positioned on the other side of the negative. The blank 26 is positioned in contact with the negative 18 to produce a shape of the same size as the negative, being spaced apart for purposes of illustration.

The grit-blasting mask 26 comprises a thin backing sheet 28 (FIG. 3) of plastic material or even paper and a layer 30 of photo-sensitive material, preferably commercially-available photopolymer material. The backing sheet 28 physically supports the layer 30 and can be of a polyester material with a thickness preferably from 0.0001 inch to 0.015 inch. The layer 30 is initially in a soft or liquid state on the backing sheet and is polymerized or more fully polymerized when subjected to triggering energy waves, commonly ultraviolet light. This layer preferably is from 0.005 to 0.070 inch in thickness. The areas of the layer which are subjected to the ultraviolet light for a predetermined period of time become harder as polymers and remain releasably adhered to the backing sheet 28. The areas of the layer which do not receive the ultraviolet light remain soft or liquid as monomers and can be subsequently washed away by a suitable solvent or a detergent. In this instance, the soft material is completely washed away to leave a bare surface on the backing sheet 28 with sharp definition lines between the harder portions of the layer and the bare sheet.

When the soft material is washed away, a font 32 of type remains, as shown in FIG. 3. The font includes the backing sheet 28 which serves to support characters 34 in spaced relationship with the characters being releasably adhered to the backing sheet so that they can be peeled away and replaced on the backing sheet after use. The characters 34 are of the same thickness as the layer 30, namely from 0.005 inch to 0.070 inch and are relatively soft and flexible, having a hardness of 20–100 durometers. The polymerized material also has a high degree of memory so that the characters 34 can be distorted badly and yet readily return to their original shape. The characters are also highly resistant to blasting grit.

Figure 4:
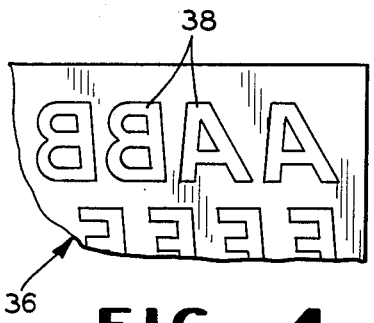
FIG. 4 is a fragmentary view of a guide sheet with the same characters printed thereon in reverse.
Figure 5:
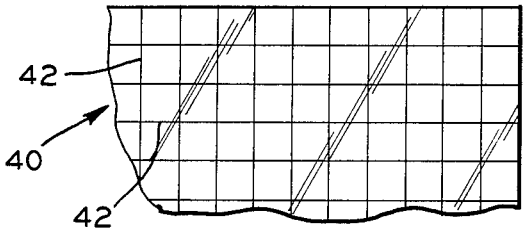
FIG. 5 is a fragmentary view of a light-transmitting transfer sheet with guide lines thereon.
Figure 6:
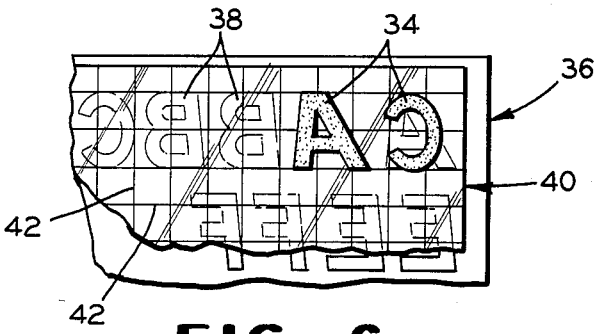
FIG. 6 is a fragmentary view of the guide sheet with the transfer sheet positioned thereon and with characters from the font of FIG. 3 on the transfer sheet.

At this point, the characters 34 can be placed directly on the surface of the body of grit-erodible material and the grit directed theretoward to erode the surface around the characters. However, the characters 34 preferably are first positioned on a transfer sheet in proper spaced relationship and then transferred to the surface of the body. Toward this purpose, a guide sheet 36 of FIG. 4 has characters 38 printed thereon identical in size and shape and order to the characters 34 of the sheet 28 but in reverse. A transfer sheet 40 of FIG. 5 is also provided to aid in spacing of the characters 34. The transfer sheet 40 is light-transmitting and has mutually perpendicular guide lines 42 thereon in a preferred form. The horizontal guide lines are important to line up the sheet with the rows of characters 38 on the guide sheet 36 and the vertical guide lines help in spacing the characters on the transfer sheet 40, particularly if the guide sheet 36 is not used.

The transfer sheet 40 is placed over the guide sheet 36 and the characters 34 are then reversed and placed on the transfer sheet in superimposed relationship with the printed characters 38 on the guide sheet 36. Thus, to spell the word "CAB" on a body, the transfer sheet 40 is positioned with one of the horizontal guide lines 42 in line with the bottom of the row of characters 38 containing the letter "C". A "C" character 34 is then superimposed on the "C". Subsequently, the transfer sheet is moved to place the left hand extremity of the character "C" on the left hand extremity of one printed character "A" on the guide sheet and the character "A" from the font 32 is positioned on the transfer sheet in superimposed relationship with the printed character "A" on the guide sheet. This assures proper spacing between the "C" and "A". The "B" character from the font 32 is then properly positioned on the transfer sheet above the printed "B", the transfer sheet not needing to be moved in this instance.

Figure 7:
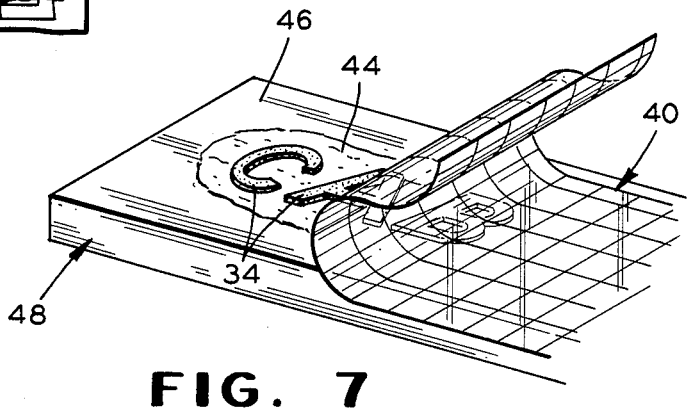
FIG. 7 is a view in perspective of a body of grit-erodible material with characters of the font of FIG. 3 adhered to a surface thereof and with the transfer sheet partially removed.
Figure 8:
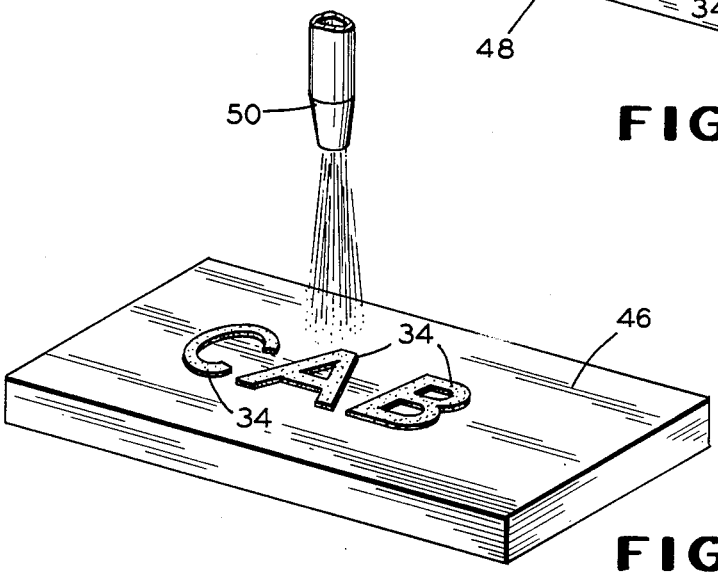
FIG. 8 is a view in perspective of the body of grit-erodible material with the characters positioned thereon and a grit-blasting nozzle directing grit toward the surface around the characters.

A thin adhesive layer 44 is applied to a surface 46 of a grit-erodible body 48, as shown in FIG. 7, or on the backs of the characters. The transfer sheet 40 with the characters 34 releasably adhered thereto in reverse is then turned over and placed on the surface 46. If desired, a horizontal line can first be drawn on the surface 46 to aid in aligning the characters 34 thereon. The transfer sheet 40 is then peeled away with the characters 34 adhering to the surface 46 by the adhesive layer 44. A roller can then be used to press the characters 34 in place to assure good contact so that they will not be moved in the grit-blasting process. Grit is then directed toward the surface 46 from a suitable grit-blasting nozzle 50, as shown in FIG. 8, until the surface around the characters 34 is eroded to the desired depth. Subsequently, the characters 34 can be peeled from the surface 46 and returned to the backing sheet 28 for subsequent reuse.

From the above, it will be seen that any number of words or messages can be blasted into a grit-erodible body and the characters 34 can be made in an almost infinite number of styles. The characters can also be reused to keep costs at a minimum and it is not necessary to make a completely new mask for each sign or message.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A font of type for grit-blasting masks comprising a thin backing sheet, a multiplicity of characters including letters and numerals of one style, releasably affixed in lines to said sheet in orderly, spaced fashion, each of said characters being made of a material which is flexible and resistant to blasting grit.

2. A font of type according to claim 1 characterized by said material being polymerized.

3. A font of type according to claim 1 characterized by said characters having a thickness from 0.005 inch to 0.070 inch.

4. A font of type according to claim 1 characterized by said material having a hardness of 20–100 durometers.

5. A font of type according to claim 1 characterized by said backing sheet being of plastic material.

6. A method of producing characters comprising letters on a body of grit-erodible material with an eroded background around the characters, said method comprising producing a negative of a font of characters, providing a grit-blasting mask blank comprising a backing sheet and a layer of photosensitive material thereon, directing triggering energy waves through said negative onto said blank to harden portions of the photosensitive material receiving the waves in the shapes of the characters in predetermined relationship on said backing sheet, removing all other portions of the photosensitive material to leave the bare backing sheet therebelow, placing selected ones of the resulting characters from said sheet on a surface of the grit-erodible body in predetermined relationship which is different than the predetermined relationship of the characters on the backing sheet, directing grit toward said surface around said characters to erode the surface to a desired depth, and removing the characters from the surface.

7. A method according to claim 6 characterized by placing selected ones of the characters on the surface of the grit-erodible body by first reversing the characters and positioning them on a transfer sheet, turning over the transfer sheet and moving it onto the surface of the grit-erodible body, and removing the transfer sheet from the characters, leaving them in place on the surface.

8. A method according to claim 6 characterized by placing selected ones of the resulting characters on the surface of the grit-erodible body by providing a guide sheet having printed thereon in reverse and in the same positions the characters on said backing sheet, providing a light-transmitting transfer sheet with guide lines thereon, positioning said transfer sheet on said guide sheet, positioning the selected characters on said transfer sheet in superimposed relationship with corresponding characters on the guide sheet, turning over the transfer sheet with the selected characters thereon and moving same to the surface of the grit-erodible body, adhering the selected characters to the surface of the body, and removing the transfer sheet from the selected characters.

9. A method according to claim 8 characterized by applying a layer of adhesive to the surface of the body prior to adhering the selected characters thereto.

10. A method according to claim 6 characterized by placing the removed characters from the surface onto the backing sheet.

11. A method according to claim 6 characterized by the layer of photosensitive material on the backing sheet being polymerizable, and directing triggering energy waves in the form of ultraviolet light through said negative onto said blank to harden portions of the polymerizable material receiving the waves.

12. A method of producing words on a body of grit-erodible material with an eroded background around the letters of the words, said method comprising producing a negative of a font of letters, providing a grit-blasting mask blank comprising a backing sheet and a layer of photosensitive material thereon, directing triggering energy waves through said negative onto said blank to harden portions of the photosensitive material receiving the waves in the shapes of the letters positioned in lines on the backing sheet, removing all other portions of the photosensitive material to leave the bare backing sheet therebelow, providing a guide sheet having printed thereon in reverse, and in the same positions, the letters on said back sheet, providing a light-transmitting transfer sheet, positioning said transfer sheet on said guide sheet, turning over selected letters from said backing sheet and positioning the selected letters on said transfer sheet in superimposed relationship with corresponding letters on the guide sheet, turning over the transfer sheet with the selected letters thereon in predetermined positions, moving said transfer sheet and letters to the surface of the grit-erodible body, adhering the selected letters to the surface of the body in the same positions as they are on the transfer sheet, and removing the transfer sheet from the selected letters.

13. A method according to claim 12 characterized by applying a layer of adhesive to the surface of the body prior to adhering the selected letters thereto.

* * * * *